US007813521B2

(12) United States Patent
Lim

(10) Patent No.: US 7,813,521 B2
(45) Date of Patent: Oct. 12, 2010

(54) SPEAKER APPARATUS

(75) Inventor: Soo-chan Lim, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1148 days.

(21) Appl. No.: 11/254,699

(22) Filed: Oct. 21, 2005

(65) Prior Publication Data

US 2006/0204028 A1 Sep. 14, 2006

(30) Foreign Application Priority Data

Mar. 11, 2005 (KR) ..... 10-2005-0020540

(51) Int. Cl.
*H04R 1/00* (2006.01)

(52) U.S. Cl. ..... 381/396; 381/421

(58) Field of Classification Search ..... 381/396, 381/400, 401, 412, 420, 421
See application file for complete search history.

(56) References Cited

U.S. PATENT DOCUMENTS 1,951,692 A * 3/1934 Evens ..... 381/186
1,980,957 A * 11/1934 Parry ..... 381/186
3,665,124 A * 5/1972 Sotome ..... 381/401
3,679,833 A * 7/1972 Inoue ..... 381/17
4,438,297 A * 3/1984 Kawamura ..... 381/401
6,031,925 A * 2/2000 Shteyn ..... 381/401
6,404,896 B1 * 6/2002 Yoo et al. ..... 381/401
6,741,721 B2 * 5/2004 Fukawatase et al. ..... 381/401
2002/0114486 A1 * 8/2002 Fukawatase et al. ..... 381/401

FOREIGN PATENT DOCUMENTS

| | | |
|---|---|---|
| JP | 09-168196 | 6/1997 |
| JP | 10-294986 | 11/1998 |
| KR | 1999-041872 | 6/1999 |
| KR | 20-0196826 | 7/2000 |
| KR | 1020010089034 | 9/2001 |
| KR | 1020020039057 | 5/2002 |

* cited by examiner

*Primary Examiner*—Walter F Briney, III
(74) *Attorney, Agent, or Firm*—Roylance, Abrams, Berdo & Goodman, L.L.P.

(57) ABSTRACT

A speaker apparatus includes a speaker frame, an acoustic vibrating plate movably supported on the speaker frame, and a magnetic driver formed in the speaker frame for vibrating the acoustic vibrating plate. The magnetic driver is connected such that it may vibrate different portions of the acoustic vibrating plate independently. The acoustic vibrating plate of the speaker apparatus may vibrate with the same phase, thereby increasing sound pressure and improving acoustic efficiency.

7 Claims, 3 Drawing Sheets

SPEAKER APPARATUS

CROSS-REFERENCE TO RELATED APPLICATIONS

This application claims the benefit under 35 U.S.C. §119 (*a*) of Korean Patent Application No. 2005-20540 filed on Mar. 11, 2005 in the Korean Intellectual Property Office, the entire disclosure of which is hereby incorporated by reference.

BACKGROUND OF THE INVENTION

1. Field of the Invention

The present invention relates to a speaker apparatus for converting an electrical signal into a sound signal.

2. Description of the Related Art

A conventional speaker apparatus converts an electrical signal into a sound signal according to Fleming's right-hand rule, which explains why a conductor located in a magnetic field has a current flow moving in a certain direction due to an acting force. An example of a conventional speaker apparatus is illustrated in FIG. 1.

As illustrated in FIG. 1, the speaker apparatus has a permanent magnet 30 placed between top and bottom metal plates 64 and 63. The opposite side of an inner surface of the permanent magnet 30 is an inner magnet 40 that protrudes vertically such that it has a certain gap from the inner surface of the top metal plate 64.

A bobbin 51, wound by a voice coil 50, is inserted between the permanent magnet 30 and the inner magnet 40. The top of the bobbin 51 is connected to the bottom of an acoustic vibrating plate 20. The top of the acoustic vibrating plate 20 is fixed to a speaker frame 10, which is fixed to the top metal plate 64.

Here, an edge 65 is formed between the speaker frame 10 and the acoustic vibrating plate 20 for preventing a split vibration of the acoustic vibrating plate 20, while a damper 60 for regulating the vibrational range of the acoustic vibrating plate 20 is formed between the bobbin 51 and the speaker frame 10. Additionally, a dust cap 67 that prevents the inflow of external dust is disposed on the top of the bobbin 51.

With this configuration of the speaker apparatus, a magnetic field is generated between the permanent magnet 30, the top and bottom plates 64 and 63 contacting the permanent magnet, and the inner magnet 40. Additionally, an electrical current is applied to the voice coil 50.

A force acts on the bobbin 51, wound by the voice coil 50, due to a current flow of the voice coil 50 and a magnetic flux flowing through the permanent magnet 30, the top and bottom metal plates 64 and 63 and the inner magnet 40.

That is, the bobbin 51 vibrates up and down according to Fleming's right-hand rule. The vertically vibrating bobbin 51 causes a vibrational motion in the acoustic vibrating plate 20 connected to the bobbin 51, so that a sound is generated.

However, a problem occurs in that the acoustic vibrating plate 20 cannot vibrate in the same phase when the acoustic vibrating plate 20 is vibrated by the bobbin 51 disposed in a central portion of the acoustic vibrating plate 20. That is, the top and bottom of the acoustic vibrating plate 20, being respectively connected to the speaker frame 10 and the bobbin 51, have different vibration speeds, which generate a split vibration. The split vibration affects the sound pressure of the speaker apparatus and causes an impediment to uniform sound quality.

Accordingly, a need exists for an acoustic vibrating plate that vibrates in the same phase to provide an improved speaker apparatus having a high acoustic efficiency.

SUMMARY OF THE INVENTION

An object of the present invention is to provide a speaker apparatus with an improved configuration for vibrating an acoustic vibrating plate with the same phase, thereby having a high acoustic efficiency.

A speaker apparatus includes a speaker frame, an acoustic vibrating plate movably connected to the speaker frame, and a magnetic driver formed in the speaker frame for vibrating the acoustic vibrating plate. The magnetic driver is connected in such a way that it causes vibrations in different portions of the acoustic vibrating plate independently.

According to one aspect of the present invention, the magnetic driver preferably includes a first magnetic circuit for vibrating a central portion of the acoustic vibrating plate, and a second magnetic circuit for vibrating a specific portion between the central and the peripheral portions of the acoustic vibrating plate.

The first magnetic circuit preferably includes a first magnet formed corresponding to the center of the acoustic vibrating plate; a second magnet winding around the first magnet with a predetermined gap therebetween; and a first coil unit connected to the acoustic vibrating plate, disposed between the first and second magnets, and adapted to be moved by an interaction with the first and second magnets when current is applied thereto.

The first coil unit preferably includes a first bobbin connected to the acoustic vibrating plate, and a first coil wound around the first bobbin and to which current is applied.

Additionally, the second magnetic circuit preferably includes a third magnet formed in a specific portion between the central and the peripheral portions of the acoustic vibrating plate to wind around the second magnet; a fourth magnet formed to wind around the third magnet with a predetermined gap therebetween; and a second coil unit connected to the acoustic vibrating plate, disposed between the third and fourth magnets, and adapted to be moved by an interaction with the first and second magnets when current is applied thereto.

Preferably, the second and third magnets are the same magnet.

Additionally, the second coil unit preferably includes a second bobbin connected to the acoustic vibrating plate, and a second coil wound around the second bobbin and applied with a current.

Additionally, it is preferable to include a first damper supporting the first bobbin on the speaker frame and maintaining the balance of the first bobbin, and a second damper supporting the second bobbin on the speaker frame and maintaining the balance of the second bobbin.

Additionally, it is preferable to include a bottom metal plate having the first and fourth magnets and connected to the speaker frame, and a top metal plate formed opposite of the bottom metal plate and across the second and third magnets.

The magnetic driver preferably includes the bottom metal plate connected to the speaker frame and has concentric inner and outer magnets respectively disposed inside and outside thereof. A permanent magnet supported on the bottom metal plate is disposed between the inner and outer magnets. The first coil unit is disposed between the inner and the permanent magnets and connected to the acoustic vibrating plate for operation. The second coil unit is disposed between the outer and the permanent magnets and connected to the acoustic vibrating plate for operation.

Preferably, the top metal plate is connected to the permanent magnet corresponding to the bottom metal plate.

Additionally, it is preferable to include the damper supporting the first and second coil units on the speaker frame to facilitate maintaining the balance of the first and second coil units.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Exemplary embodiments of the present invention are described in greater detail with reference to the accompanying drawings.

Figure 1:
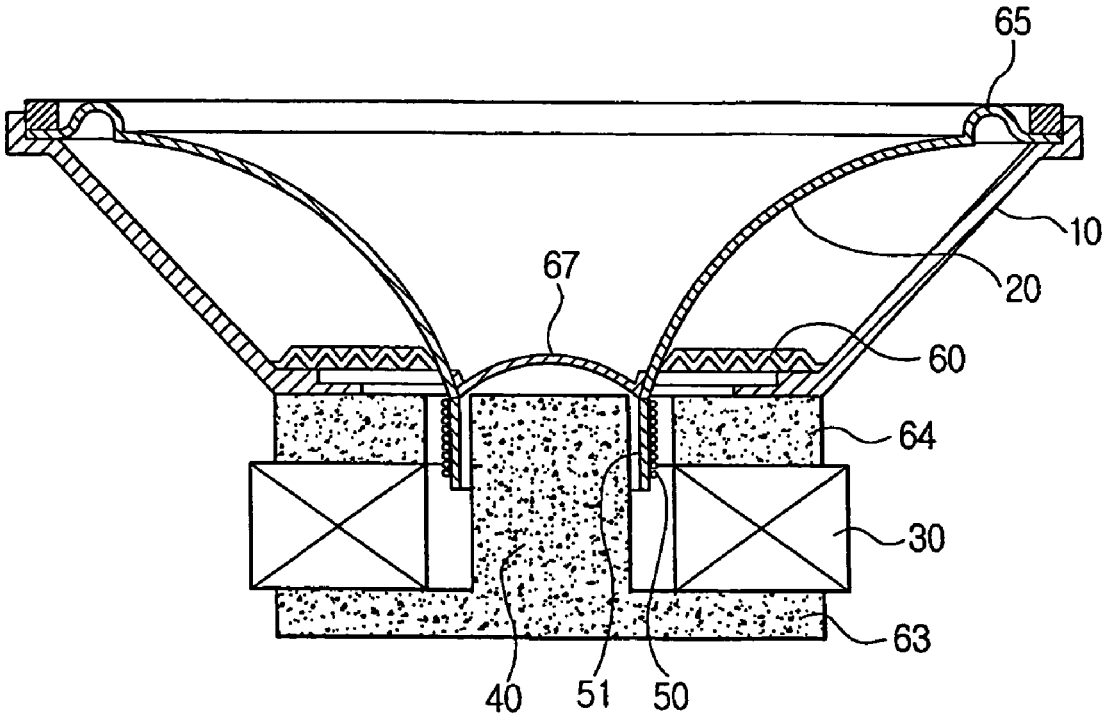
FIG. 1 (PRIOR ART)
FIG. 1 is an elevational view in cross section of a conventional speaker apparatus.
Figure 2:
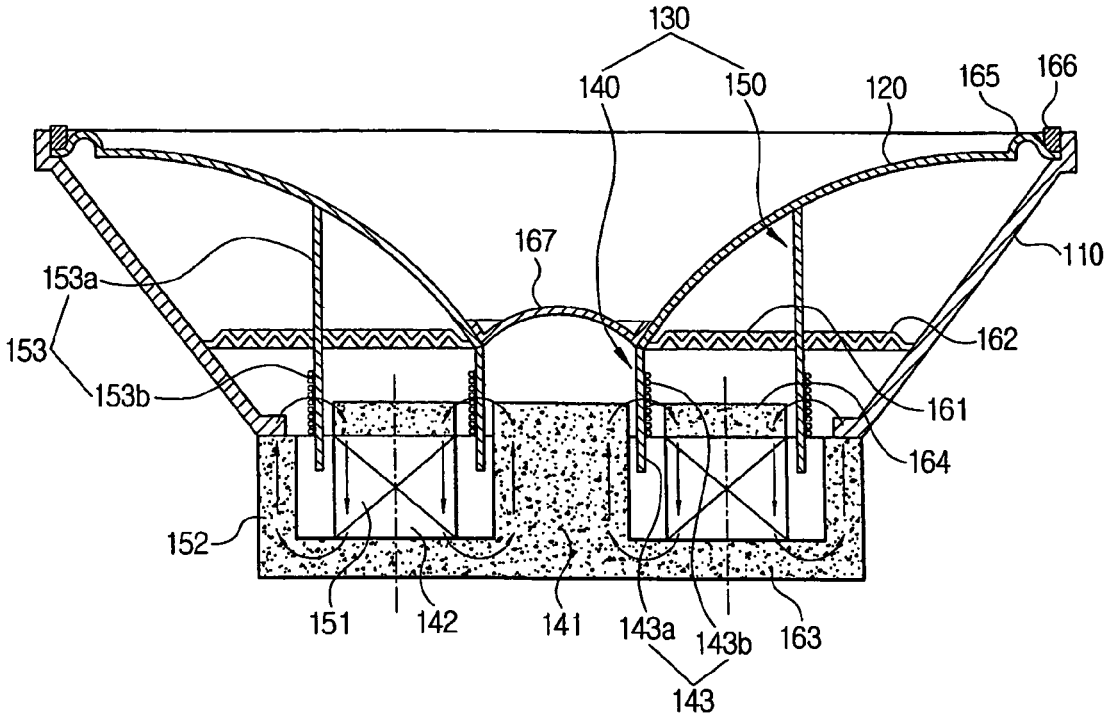
FIG. 2 is an elevational view in cross section of a speaker apparatus according to an exemplary embodiment of the invention.
Figure 3:
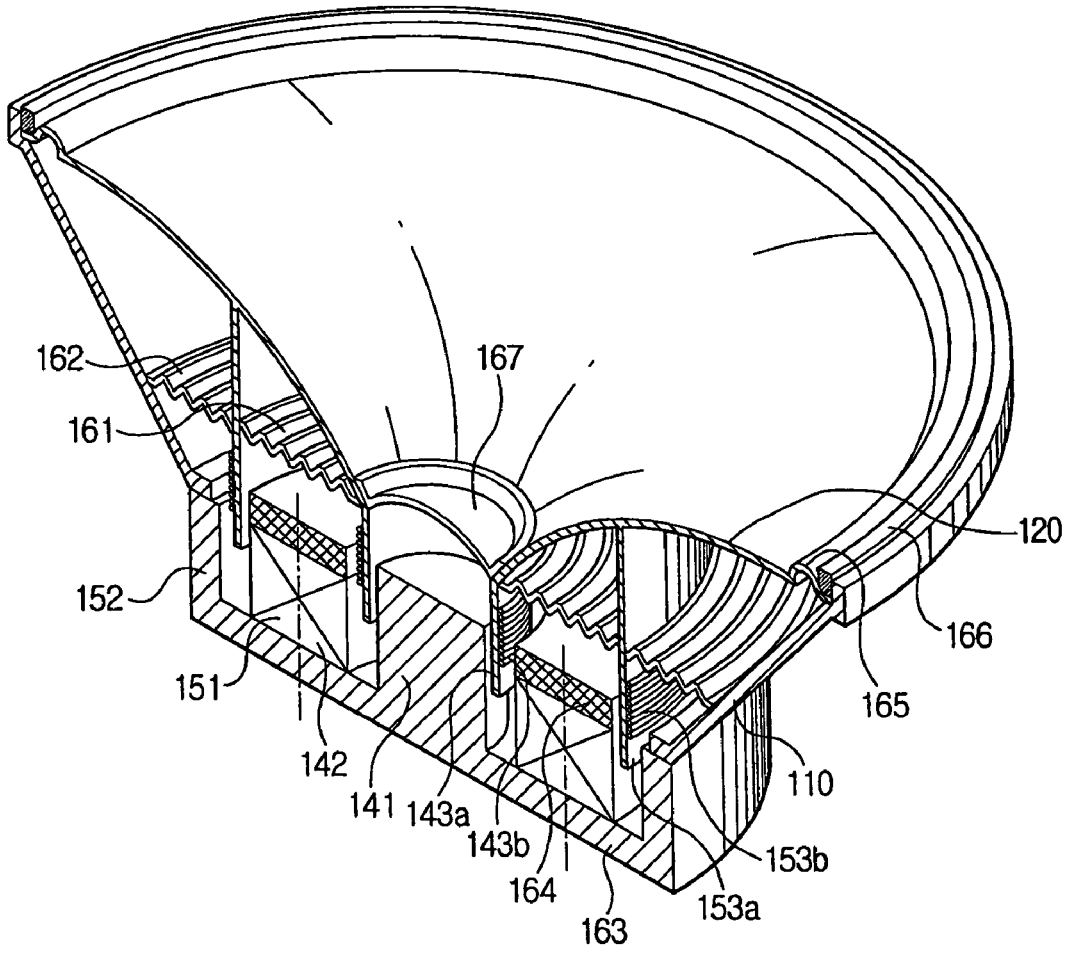
FIG. 3 is a perspective view in partial cross section of the speaker apparatus shown in FIG. 2.

As illustrated in FIGS. 2 and 3, a speaker apparatus according to an exemplary embodiment of the present invention includes a speaker frame 110, an acoustic vibrating plate 120 and a magnetic driver 130.

The speaker frame 110 supports the acoustic vibrating plate 120 and the magnetic driver 130, and forms an external appearance of the speaker apparatus.

The acoustic vibrating plate 120 is movably supported on the speaker frame 110. The acoustic vibrating plate 120 is preferably cone-shaped having an open central portion for generating sound by a vertical vibration.

The magnetic driver 130 is formed in the speaker frame 110 and vibrates the acoustic vibrating plate 120. Additionally, according to an exemplary embodiment of the present invention, the magnetic driver 130 is connected in such a way that it causes vibrations in different portions of the acoustic vibrating plate 120 independently. For this purpose, the magnetic driver 130 includes first and second magnetic circuits 140 and 150.

The first magnetic circuit 140 vibrates a central portion of the acoustic vibrating plate 120, and includes first and second magnets 141 and 142, and a first coil unit 143.

The first magnet 141 is formed substantially corresponding to a center of the acoustic vibrating plate 120. The second magnet 142 is formed to wind around the first magnet 141 with a predetermined gap from the first magnet 141. That is, the second magnet 142 has a doughnut-type shape to thereby wrap around, or be disposed substantially concentrically to, the first magnet 141.

The first coil unit 143 is connected to the acoustic vibrating plate 120, disposed between the first and second magnets 141 and 142, and is adapted to be moved by an interaction with the first and second magnets 141 and 142 when a current is applied. The first coil unit 143 includes a first bobbin 143*a* connected to the acoustic vibrating plate 120 and a first coil 143*b* wound around the first bobbin 143*a* and adapted to have current applied thereto.

The first coil unit 143 is disposed in a magnetic field generated by the first and second magnets 141 and 142 so that it moves vertically by an attractive or repulsive force when applying a current to the first coil 143*b*. The acoustic vibrating plate 120 connected to the first bobbin 143*a* also vibrates vertically to thereby generate a sound.

The technical configuration of the first coil unit 143 is understood with Fleming's right-hand rule, which explains why a conductor having a current flow moves in a certain direction due to an acting force when located in a magnetic field.

The second magnetic circuit 150 vibrates a central portion of the acoustic vibrating plate 120 and a specific portion between the central and the peripheral portions of the acoustic vibrating plate 120. The second magnetic circuit 150, like the first magnetic circuit 140, includes third and fourth magnets 151 and 152, and a second coil unit 153.

The third magnet 151 is formed in a specific portion between the central and the peripheral portions of the acoustic vibrating plate 120 in such a way that it wraps around (or is concentrically disposed with respect to) the second magnet 142. The fourth magnet 152 is formed to wrap around the third magnet 151 with a predetermined gap between the third and fourth magnets 151.

The third magnet 151 is preferably the same as the second magnet 142. More preferably, it is a permanent magnet arranged between the first and fourth magnets 141 and 152. That is, the second and third magnets 142 and 151 have a substantially doughnut-type shape, and inner and outer surfaces thereof are opposite to the first 141 and fourth magnets 152, respectively.

The second coil unit 153 is connected to the acoustic vibrating plate 120, disposed between the third and fourth magnets 151 and 152, and adapted to be moved by an interaction with the third and fourth magnets 151 and 152 when current is applied thereto.

Additionally, the second coil unit 153, like the first coil unit 143, includes a second bobbin 153*a* connected to and vibrating the acoustic vibrating plate 120. A second coil 153*b* is wound around the second bobbin 153*a* and a current is applied thereto.

The current applied to the second coil 153*b* is substantially the same as that applied to the first coil 143*b*. The first and second coils 143*b* and 153*b* are wound in the opposite direction along the outer circumferences of the first and second bobbins 153*a*, respectively. This configuration vibrates the acoustic vibrating plate 120 with the same phase according to Fleming's right-hand rule when the same current is applied to the first and second coils 153*b*.

Meanwhile, according to an exemplary embodiment of the invention, the first and second coils 143*b* and 153*b* are wound in opposite directions, which does not limit the present invention. That is, when different currents are applied to the first and second coils 143*b* and 153*b*, the first and second coils 143*b* and 153*b* may be wound in the same direction along the outer circumferences of the first and second bobbins 143*a* and 153*a*.

Addition, according to an exemplary embodiment of the present invention, the speaker apparatus additionally includes first and second dampers 161 and 162, top and bottom metal plates 164 and 163, an edge 165, a gasket 166, and a dust cap 167.

The first and second dampers 161 and 162 support the first and second bobbins 143*a* and 153*a* on the speaker frame 110. That is, the first damper 161 is disposed between the first and second bobbins 143*a* and 153*a*, and the second damper 162 is disposed between the second bobbin 153*a* and the speaker frame 110, so that they support the first and second bobbins 143*a* and 153*a* on the speaker frame 110.

The first and second dampers 161 and 162 maintain the balance of the first and second bobbins 143*a* and 153*a*, and limit the vibrational range of the first and second coil units 143 and 153 to prevent contact with the first through the fourth magnets 141, 142, 151 and 152. The first and second dampers 161 and 162 are preferably made from an elastic material having a good restoration force against the vibration of the first and second bobbins 143*a* and 153*a*.

The bottom metal plate 163 has the first and fourth magnets 141 and 152. That is, the first and fourth magnets 141 and 152 are formed on an elongated axis of the inside and outside of the bottom metal plate 163 with respect to a concentric point.

Additionally, the bottom metal plate 163 is connected to the speaker frame 110. More specifically, the fourth magnet 152 is elongated from the bottom metal plate 163 and is connected to the speaker frame 110.

The top metal plate 164 is formed opposite to the bottom metal plate across the second and third magnets 142 and 151, which are preferably both the same magnet, and is connected to the second and third magnets 142 and 151.

The top and bottom metal plates 164 and 163 are magnetized by the second and third magnets 142 and 151, which are preferably the same permanent magnet. More preferably, the first and fourth magnets 141 and 152 of the bottom metal plate 163 are magnetized by the permanent magnet, the second and third magnet 142, 151.

The edge 165 connects the top of the acoustic vibrating plate 120 to the speaker frame 110, thereby maintaining the balance of the acoustic vibrating plate 120. The edge 165 may be formed simultaneously when manufacturing the acoustic vibrating plate 120, or may be manufactured separately and then formed by attaching it to the acoustic vibrating plate 120.

The gasket 166 fixes the edge 165 to the speaker frame 110 so that the edge 165 cannot be separated from the speaker frame 110 by the vibration of the acoustic vibrating plate 120.

The dust cap 167 is formed at the open central portion of the acoustic vibrating plate 120 for preventing the inflow of external dust into the magnetic driver 130 and maintaining the balance of the acoustic vibrating plate 120. The dust cap 167, like the edge 165, may be formed simultaneously when manufacturing the acoustic vibrating plate 120, or may be formed separately and then connected to the acoustic vibrating plate 120.

Operation of the speaker apparatus having the above configuration will be described with reference to FIGS. 2 and 3.

As illustrated in FIGS. 2 and 3, the first and fourth magnets 141 and 152, and the top and bottom metal plates 164 and 163 are magnetized by the same permanent magnet of the second and third magnets 142 and 151, which generates a magnetic field as indicated by the arrows in FIG. 2. The direction of a magnetic flux formed by the first and second magnets 141 and 142 and the top and bottom metal plates 164 and 163 is different from that formed by the third and fourth magnets 151 and 152 and the top and bottom metal plates 164 and 163.

The first and second coil units 153, wound by the first and second coils 143*b* and 153*b*, are arranged in the opposite direction around the outer circumferences of the first and second bobbins 143*a* and 153*a* in the generated magnetic field. When current is applied to the first and second coils 143*b* and 153*b* by a terminal (not illustrated), the first and second bobbins 143*a* and 153*a* vibrate vertically according to Fleming's right-hand rule.

With this vibration, the acoustic vibrating plate 120 connected to the first and second bobbins 143*a* and 153*a* vibrates vertically. The vibration of the acoustic vibrating plate 120 oscillates contacting air, thereby generating sound.

As described above, the first and second magnetic circuits 140 and 150 vibrate the acoustic vibrating plate 120 of the speaker apparatus, so that the acoustic vibrating plate 120 vibrates with the same phase.

For the speaker of the exemplary embodiment of the present invention, the magnetic driver having the first and second magnetic circuits vibrates the acoustic vibrating plate so that different portions of the acoustic vibrating plate may vibrate independently. Because of this operation, all portions of the acoustic vibrating plate may vibrate with the same phase to thereby increase sound pressure and improve acoustic efficiency.

The foregoing exemplary embodiments and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A speaker apparatus, comprising:

a speaker frame;

an acoustic vibrating plate movably supported to the speaker frame;

a magnetic driver connected to the speaker frame adapted to vibrate the acoustic vibrating plate, wherein the magnetic driver independently vibrates different portions of the acoustic vibrating plate; and a gasket connected to the speaker frame and to the acoustic vibrating plate to prevent separation of the acoustic vibrating plate from the speaker frame by vibration of the acoustic vibrating plate, the gasket being formed separately from the acoustic vibrating plate, wherein the magnetic driver includes a first magnetic circuit adapted to vibrate a central portion of the acoustic vibrating plate; and a second magnetic circuit adapted to vibrate a specific portion between the central portion and a peripheral portion of the acoustic vibrating plate, wherein the first magnetic circuit includes a first magnet formed corresponding to the center of the acoustic vibrating plate;

a second magnet wound around the first magnet with a predetermined gap therebetween; and a first coil unit connected to the acoustic vibrating plate disposed between the first and second magnets and adapted to be moved by an interaction with the first and second magnets when current is applied thereto, wherein the first coil unit includes a first bobbin connected to the acoustic vibrating plate; and a first coil wound around the first bobbin to which current is applied, wherein the second magnetic circuit includes a third magnet formed at a specific portion between the central and the peripheral portions of the acoustic vibrating plate and wound around the second magnet;

a fourth magnet wound around the third magnet with a predetermined gap therebetween; and a second coil unit connected to the acoustic vibrating plate and disposed between the third and fourth magnets, and adapted to be moved by an interaction with the third and fourth magnets when current is applied thereto, wherein the second coil unit includes a second bobbin connected to the acoustic vibrating plate; and a second coil wound around the second bobbin and to which current is applied, wherein a first damper supports the first bobbin on the speaker frame and maintains the balance of the first bobbin, the first damper being disposed between the first and second bobbins, and wherein a second damper supports the second bobbin on the speaker frame and maintains the balance of the second bobbin, the second damper being disposed between the second bobbin and the speaker frame.

2. The speaker apparatus as claimed in claim 1, wherein the second and third magnets are the same magnet.

3. The speaker apparatus as claimed in claim 1, wherein a bottom metal plate is connected to the first and fourth magnets and to the speaker frame; and a top metal plate is disposed opposite to the bottom metal plate across the second and third magnets.

4. The speaker apparatus as claimed in claim 1, wherein the second magnet is substantially ring-shaped.

5. The speaker apparatus as claimed in claim 4, wherein the second magnet is substantially concentric with respect to the first magnet.

6. The speaker apparatus as claimed in claim 1, wherein the fourth magnet is substantially concentric with respect to the third magnet.

7. The speaker apparatus as claimed in claim 1, wherein the third magnet is substantially ring-shaped.

* * * * *